US007647655B2

(12) United States Patent
Liljedahl

(10) Patent No.: US 7,647,655 B2
(45) Date of Patent: Jan. 19, 2010

(54) APPARATUS FOR TRANSPORTATION OF A DISABLED PERSON IN STANDING POSITION

(75) Inventor: Gunnar Liljedahl, Luleå (SE)

(73) Assignee: LIKO Research & Development AB, Lulea (SE)

( * ) Notice: Subject to any disclaimer, the term of this patent is extended or adjusted under 35 U.S.C. 154(b) by 232 days.

(21) Appl. No.: 11/795,960

(22) PCT Filed: Feb. 15, 2006

(86) PCT No.: PCT/SE2006/000205

§ 371 (c)(1),
(2), (4) Date: Jul. 25, 2007

(87) PCT Pub. No.: WO2006/091143

PCT Pub. Date: Aug. 31, 2006

(65) Prior Publication Data

US 2009/0119835 A1 May 14, 2009

(30) Foreign Application Priority Data

Feb. 25, 2005 (SE) ..... 0500438

(51) Int. Cl.
*A61G 7/14* (2006.01)
*A61G 7/10* (2006.01)

(52) U.S. Cl. ..... 5/86.1; 5/81.1 R

(58) Field of Classification Search ..... 5/81.1 R–89.1
See application file for complete search history.

(56) References Cited

U.S. PATENT DOCUMENTS 5,526,541 A 6/1996 Massey et al.
6,175,973 B1 1/2001 Hakamiun et al.
6,568,002 B1 5/2003 Liljedahl et al.

FOREIGN PATENT DOCUMENTS

DE 20316438 4/2004

*Primary Examiner*—Alexander Grosz
(74) *Attorney, Agent, or Firm*—Dinsmore & Shohl LLP

(57) ABSTRACT

A support frame assembly for attachment to a support mast of a transport apparatus may include a support frame with a pair of downwardly directed mounting posts. Support arms may be pivotally attached to an end of each mounting post. The support arms may each comprise a back support and an open position and a closed position. When the support arms are in the closed positioned the back supports may be substantially horizontally oriented defining a support area between the support arms, the back supports and the support frame. When the support arms are in the open position the back supports may be substantially vertically oriented and the support area is open opposite the support frame.

20 Claims, 7 Drawing Sheets

APPARATUS FOR TRANSPORTATION OF A DISABLED PERSON IN STANDING POSITION

CROSS REFERENCE TO RELATED APPLICATIONS

The present application claims priority to Swedish Patent Application No. SE-0500438-7 filed Feb. 25, 2005 which is herein incorporated by reference in its entirety.

TECHNICAL FIELD

The present specification relates to apparatuses for transporting individuals and, more specifically, to apparatuses for transporting individuals while in a standing or upright position.

BACKGROUND

Various apparatuses for transporting individuals in a standing position are known. For example, Swedish patent SE-511982 discloses an aid apparatus for raising a disabled person from a sitting position to a standing position. This aid apparatus comprises a wheeled base in the form of a U-shaped frame having a post, which supports a lifting means, to which a lifting sling can be attached. The lifting sling may be positioned at least partially around the body of a person. The lifting means comprises a lifting arm having a free end which can be raised or lowered relative to the base and supports the lifting sling such that the lifting sling is also raised and lowered relative to the base.

While it is possible to use the above-mentioned aid apparatus to transport a disabled person in a standing position, the person has no fixed support against his back or in the lateral direction. Instead, the individual is suspended by the lifting sling, and may swing back and forth and laterally during transportation. Accordingly, during transport the person may be unstable and can only be transported a short distance.

Accordingly, a need exists for alternative apparatuses for transporting individuals in a stabilized standing or upright position.

SUMMARY

In one embodiment, a transport apparatus for transporting an individual in a standing position may include a wheeled base and a support mast extending substantially vertically from the wheeled base. A foot plate is positioned at a lower end of the support mast. A support frame assembly may be positioned on the support mast above the foot plate. The support frame assembly may include a support frame with a pair of downwardly directed mounting posts having a support arm pivotally attached to an end of each mounting post. The support arms may each comprise a back support. The support arms may be parallel to one another and substantially horizontal and may include an open position and a closed position such that, when the support arms are in the closed positioned, the supports are substantially horizontally oriented and define a support area between the support arms, the supports and the support frame and, when the support arms are in the open position, the supports are substantially vertically oriented and the support area is open opposite the support frame.

In another embodiment, a support frame assembly for attachment to a support mast of a transport apparatus may include a support frame with a pair of downwardly directed mounting posts. Support arms may be pivotally attached to an end of each mounting post. The support arms may each comprise a back support and an open position and a closed position. When the support arms are in the closed position the back supports may be substantially horizontally oriented defining a support area between the support arms, the back supports and the support frame. When the support arms are in the open position the back supports may be substantially vertically oriented and the support area is open opposite the support frame.

In another embodiment, a support frame assembly for attachment to a support mast of a transport apparatus may include a support frame with a pair of downwardly directed mounting posts having a support arm pivotally attached to an end of each mounting post. The support arms may each comprise a guide handle and a back support wherein, when the guide handles are in a closed positioned, the back supports are substantially horizontally oriented defining a support area between the support arms, the back supports and the support frame and, when the guide handles are in the open position, the back supports are substantially vertically oriented and the support area is open opposite the support frame.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
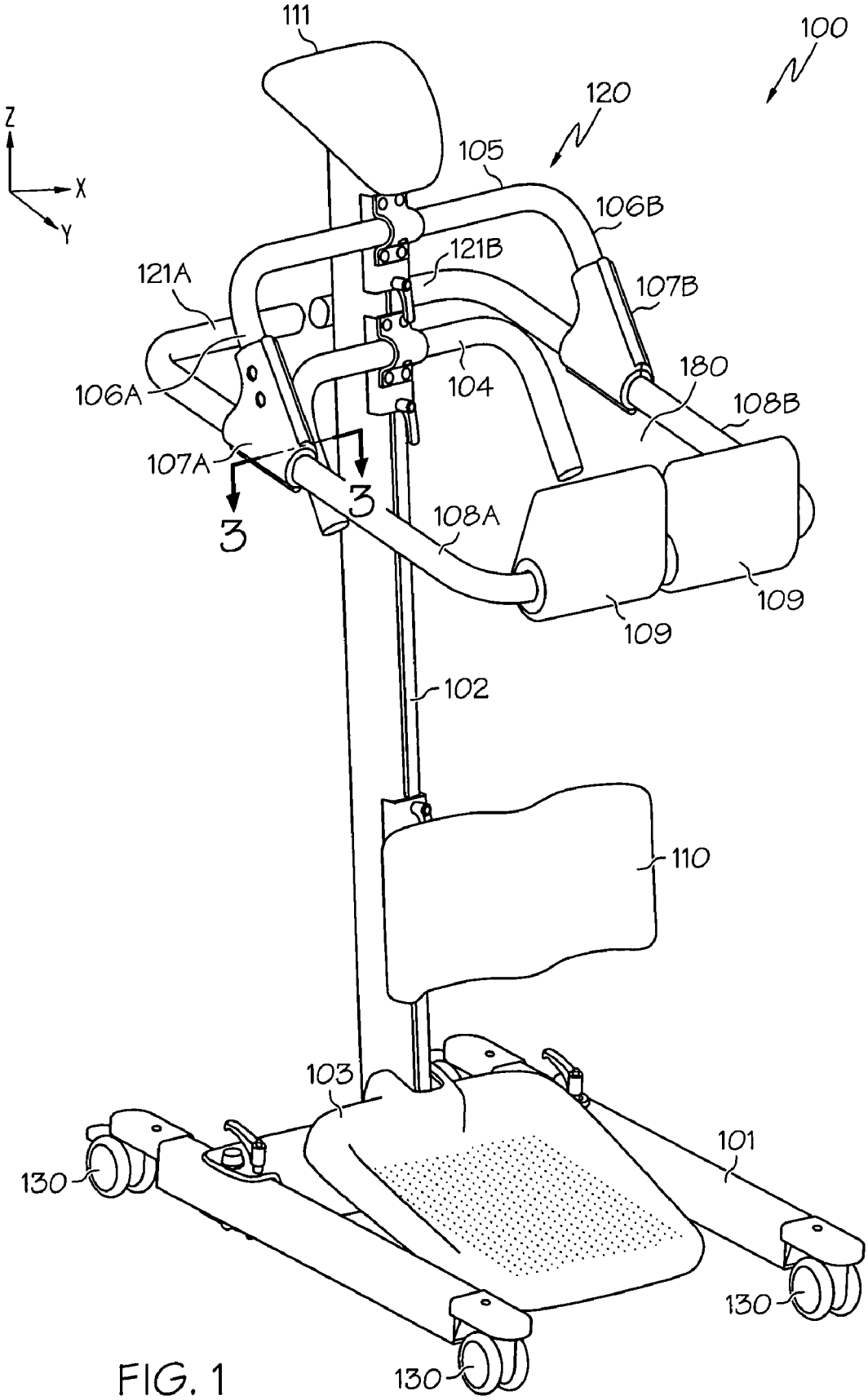
FIG. 1 depicts a transport apparatus according to one or more embodiments shown and described herein.

Referring to FIG. 1, one embodiment of a transport apparatus for transporting an individual in a standing position is depicted. The transport apparatus generally comprises a U-shaped wheeled base with a support mast and a foot plate adjustably mounted to the support mast. The support mast may support a support frame assembly which may be vertically adjusted on the support mast for adaptation to the individual to be transported. Various embodiments of the transport apparatus and the operation of the transport apparatus will be described in more detail herein.

Figure 4:
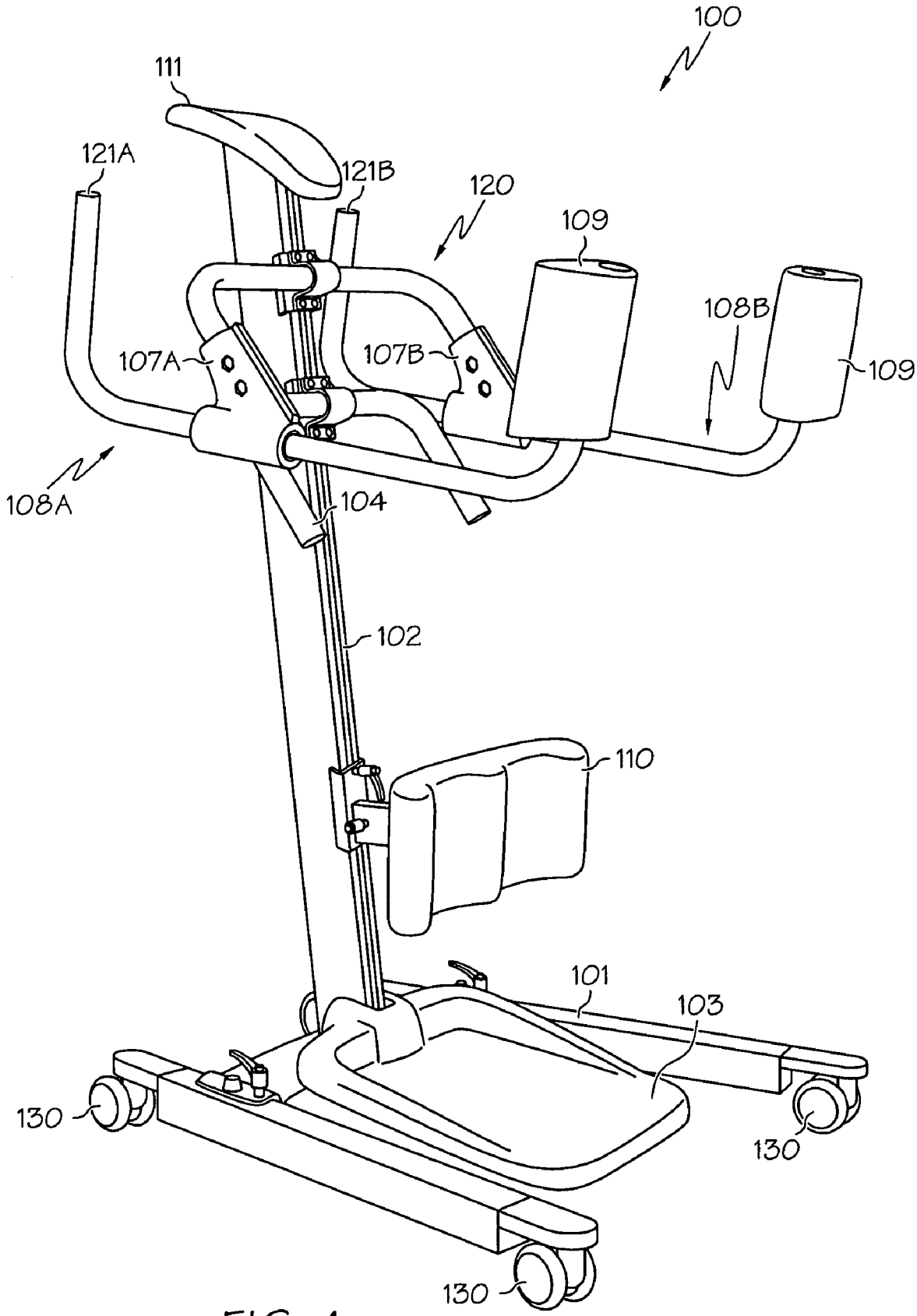
FIG. 4 depicts the transport apparatus of FIG. 1 with support arms 8A, 8B in a vertical orientation according to one embodiment shown and described herein.

Referring now to FIGS. 1 and 4, one embodiment of a transport apparatus 100 is illustrated. The transport apparatus 100 generally comprises a base 101 with a support mast 102 extending from the base 101. In the embodiments shown herein, the base 101 is a substantially U-shaped frame which comprises a plurality of wheels or casters 130. The support mast 102 extends from the base 101 in a substantially vertical direction (e.g., in a direction parallel to the z-axis of the coordinate system depicted in FIGS. 1 and 4). Accordingly, it should be understood that the support mast 102 may be vertical or, alternatively, the support mast 102 may be angled with respect to the z-axis of the coordinate system shown in FIG. 1.

Still referring to FIGS. 1 and 4, a foot plate 103 may be adjustably positioned on a lower end of the support mast 102 proximate the base 101 while a cushion 111 may be positioned on the upper end of the support mast 102. A support plate 110, support frame assembly 120, and handle frame 104 may be adjustably positioned on the support mast 102 such that each of the support plate 110, support frame assembly 120 and handle frame 104 may be adjusted on the support mast 102 to accommodate individuals of different heights and/or proportions.

As shown in FIG. 1, the support plate 110 is contoured to generally conform to the shape of an individual's lower legs. The support plate 110 may be adjustably positioned on the support mast 102 to accommodate individuals of different heights and/or proportions, as described above. However, it should be understood that the support plate 110 is generally located on the support mast 102 below the handle frame 104 and the support frame assembly 120 as shown in FIG. 1.

Still referring to FIGS. 1 and 4, in the embodiments shown herein, the handle frame 104 may be substantially U-shaped and adjustably attached to the support mast 102 between the support plate 110 and the support frame assembly 120. The handle frame 104 may be utilized by an individual to assist the individual in transitioning from a seated position to a standing position on the foot plate 103, as will be described in more detail herein.

Still referring to FIGS. 1 and 4, the support frame assembly 120 generally comprises a support frame 105, support arms 108A, 108B and support arm locking mechanisms 107A, 107B. As shown in FIG. 1, the support frame 105 is adjustably attached to the support mast 102 above the handle frame 104. The support frame 105 generally comprises two, downwardly directed mounting posts 106A, 106B oriented in parallel with one another such that the support frame 105 has a substantially U-shaped configuration. A support arm 108A, 108B may be pivotally attached to respective ends of the mounting posts 106A, 106B, as shown in FIG. 1. Each support arm 108A, 108B may be attached to the support frame 105 at the respective ends of mounting posts 106A, 106B such that the support arms 108A, 108B are parallel to one another and substantially horizontal (e.g., the support arms 108A, 108B are positioned in a plane substantially parallel to the x-y plane of the coordinate system shown in FIG. 1). The support arms generally extend in a longitudinal direction (e.g., generally in the direction of the y-axis of the coordinate system shown in FIG. 1) and may be pivoted or rotated about an axis extending in the longitudinal direction. The support arms 108A, 108B may be pivoted on the support frame 105 by about 90 degrees such that the support arms 108A, 108B are positioned in either an "open" position or a "closed" position, as will be described in more detail herein.

In the embodiments described herein, the support arms 108A, 108B may be pivotally attached to respective mounting posts 106A, 106B with locking mechanisms 107A, 107B. The support arms 108A, 108B support at their ends supports 109 adapted to be placed behind an individual when the individual is standing on the foot plate 103. Each support arm 108A, 108B may comprise a handle which extends perpendicularly from the support arm at one end and a support bracket for supporting the supports 109 extending perpendicularly from the support arm at the other end (supports 109 are depicted as positioned on the brackets in FIGS. 1 and 4), so that the support arms 108A, 108B have a generally U-shape configuration.

Figure 2:
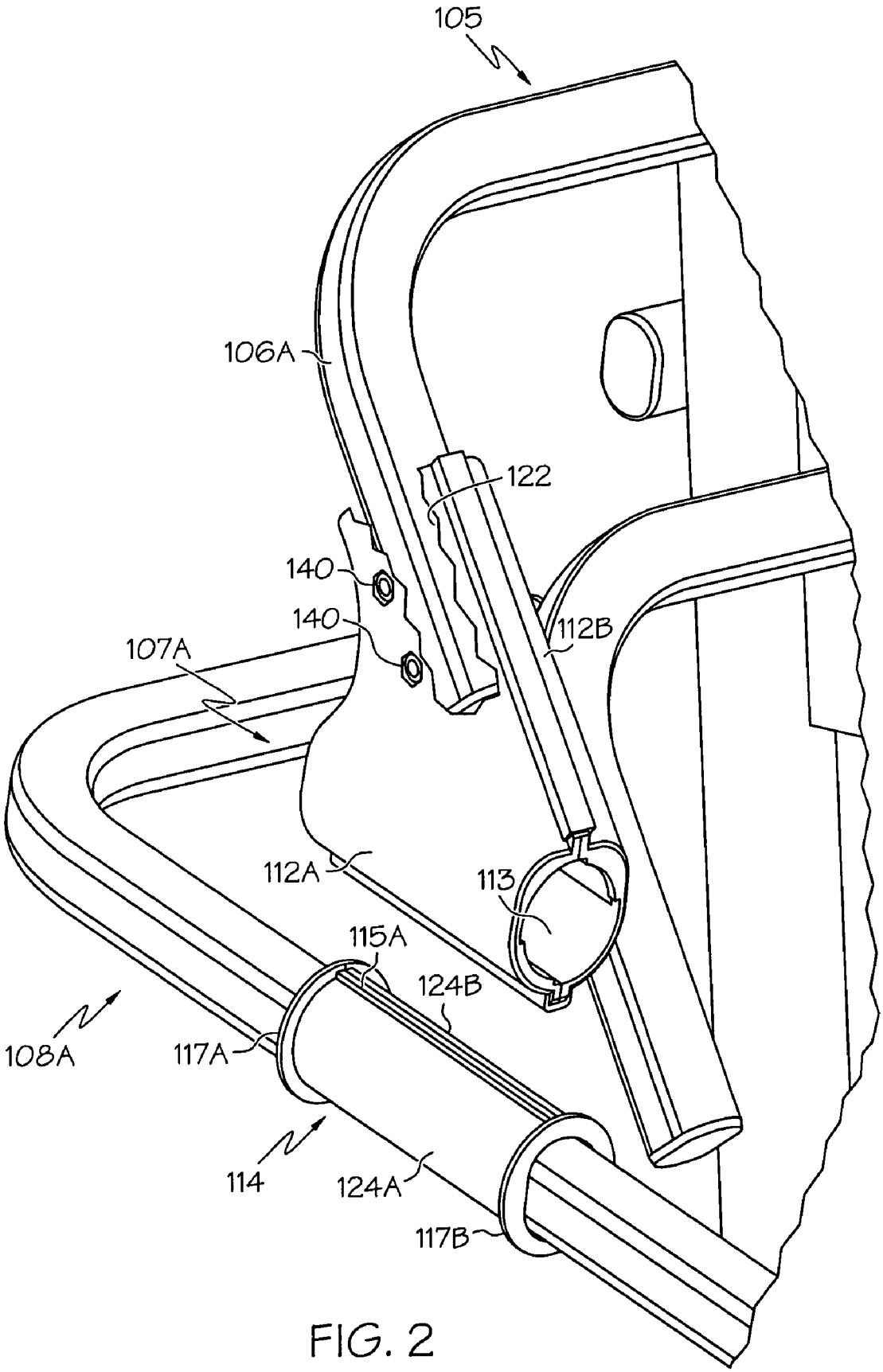
FIG. 2 depicts an enlarged view of a support arm locking mechanism and a corresponding sleeve attached to a support arm according to one embodiment.

In the embodiments of the transport apparatus 100 shown herein, the support arms 108A, 108B are attached to respective mounting posts 106A, 106B of the support frame 105 with locking mechanisms 107A, 107B which facilitate pivoting or rotating the support arms 108A, 108B about a longitudinal axis (i.e., about an axis substantially parallel to the y-direction). As shown in FIG. 2 each locking mechanism 107A, 107B may comprise a first half 112A and a second half 112B which, when assembled, form a through bore 113, in which the support arms 108A, 108B may be pivotally positioned, and a blind bore 122 in which the ends of the mounting posts 106A, 106B, respectively, may be rigidly fastened. The locking mechanisms 107A, 107B may be affixed to the support frame 105 by inserting the ends of mounting posts 106A, 106B into the blind bore 122 of the respective locking mechanisms 107A, 107B and fastening the locking mechanism to the mounting posts with fasteners 140. When the locking mechanisms 107A, 107B are affixed to the support frame 105, the through bore 113 of each locking mechanism 107A, 107B extends in a longitudinal direction (e.g., generally in the direction of the y-axis of the coordinate system shown in FIG. 1).

Figure 3:
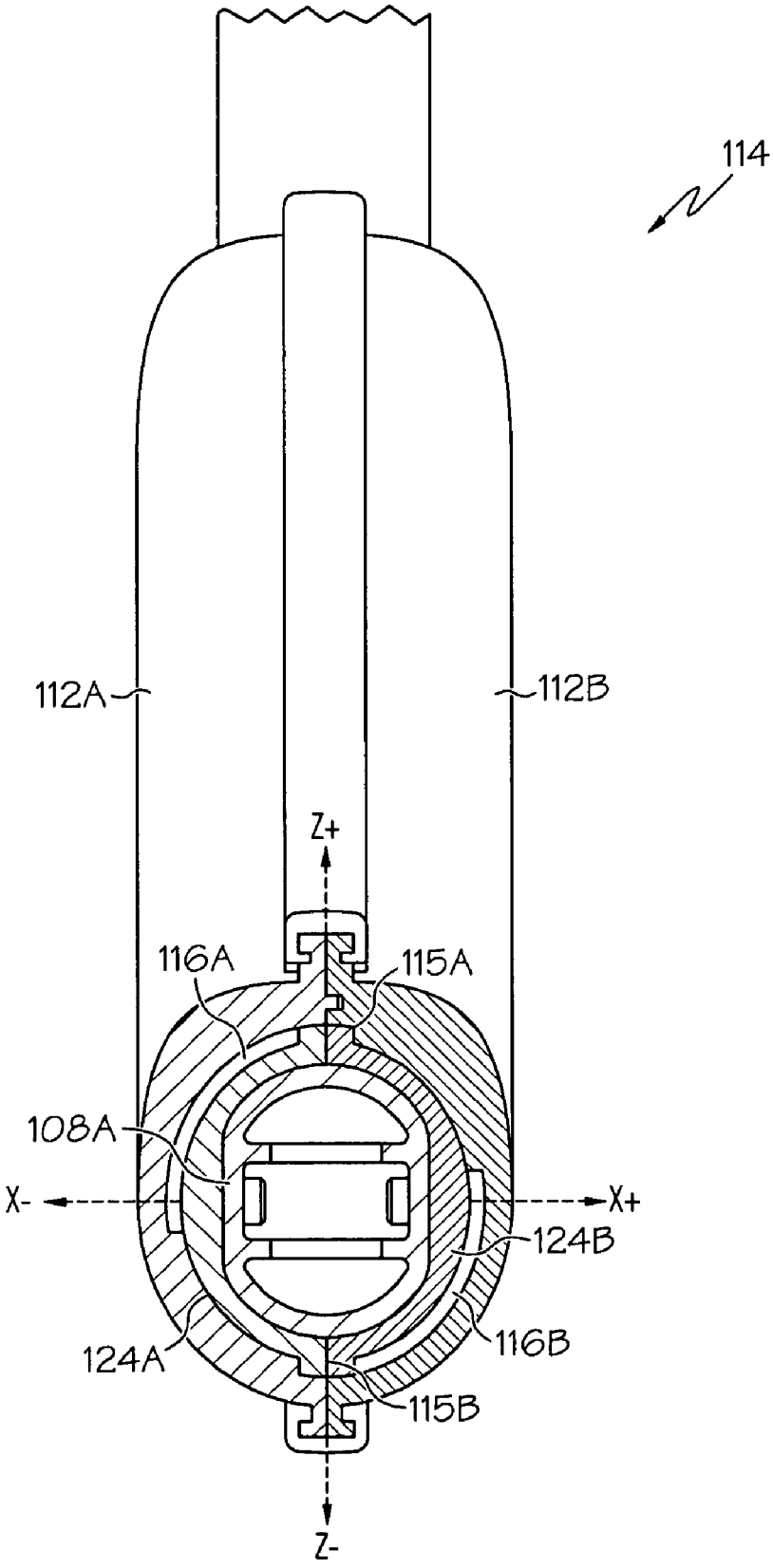
FIG. 3 depicts a cross section of a support arm locking mechanism, sleeve and support arm of the transport apparatus of FIG. 1.

In one embodiment, as shown in FIG. 3, the locking mechanism 107A, 107B comprises a two part sleeve 114 adapted to be fixed in the longitudinal direction on the support arms 108A and 108B, respectively. The sleeve 114 may include a first part 124A and a second part 124B which, when assembled around a support arm, form a pair of opposed keys 115A, 115B that extend down the longitudinal length of the sleeve 114. The sleeve 114 may also include flanged end portions 117A, 117B which prevent the support arms 108A, 108B from being displaced in the longitudinal direction when the support arms 108A, 108B are positioned in the through bores 113 of respective locking mechanisms 107A, 107B.

Referring now to FIG. 3, which shows a cross section of support arm 108A positioned in the through bore 113 of locking mechanism 107A, the keys 115A, 115B of the sleeve 114 may be positioned in correspondingly opposed channels or keyways 116A, 116B formed in the locking mechanism 107A. As shown in FIG. 3, each keyway 116A, 116B may extend partially around the circumference of the through bore 122. The keys 115A, 115B may be adapted to be turned between two end positions in each keyway 116A, 116B, respectively, formed in the first half 112A and the second half 112B of the locking mechanism 107A. For example, with reference to the coordinate axes superimposed on the cross section where z+ is the 12:00 position, z− is the 6:00 position, x+ is the 3:00 position and x− is the 9:00 position, keyway 116A extends in a 90 degree arc in the clockwise direction from just before the 9:00 position to just past the 12:00 position while keyway 116B extends in a 90 degree arc in the clockwise direction from just before the 3:00 position to just after the 6:00 position. Accordingly, it should be understood that the keys 115A, 115B of the sleeve 114 work in conjunction with the keyways 116A, 116B of the locking mechanism 107A to permit rotation of the support arm 108A by about 90 degrees. It should also be understood that the support arm 108B may be similarly arranged in locking mechanism 107B to facilitate the desired rotation of the support arm 108B relative to the locking mechanism 107B.

Reference will now be made to FIGS. 1, 3 and 4 which illustrate the support arms 108A, 108B in both the "open" position and "closed" position. Specifically referring to FIG.

1, the support arms 108A, 108B and guide handles 121A, 121B are depicted in the "closed" position. When the support arms 108A, 108B and guide handles 121A, 121B are in the "closed" position the supports 109 are rotated towards one another and are substantially horizontally oriented (e.g., oriented in a plane substantially parallel to the x-y plane of the coordinate system of FIG. 1). FIG. 3 depicts the relative orientation of the keys 115A, 115B in the keyways 116A, 116B for support arm 108A when support arm 108A and guide handle 121A are in the "closed" position. As shown in FIG. 3, the keys 115A, 115B are at the end of respective keyways 116A, 116B thereby preventing further rotation of the support arm in the clockwise direction. The keys and keyways associated with support arm 108B will have a similar orientation which prevents further rotation of the support arm 108B in the counterclockwise direction. When the support arms 108A, 108B and guide handles 121A, 121B are in the "closed" position as shown in FIG. 1, the support arms enclose a support area 180 positioned over the foot plate 103 and extending between the supports 109 and the support frame 105 in the longitudinal direction and between the support arms 108A and support arm 108B in the lateral direction (e.g., in the x-direction).

Referring now to FIG. 4, the support arms 108A, 108B and guide handles 121A, 121B are depicted in the "open" position. When the support arms 108A, 108B and guide handles 121A, 121B are in the "open" position the supports 109 are rotated away from one another and are substantially vertically oriented (e.g., oriented in a plane substantially parallel to the x-z plane of the coordinate system of FIG. 1). In this orientation the keys 115A, 115B of support arm 108A are oriented at respective ends of the keyways 116A, 116B of the locking mechanism 107A to prevent further rotation of the support arm 108A in the counterclockwise direction (e.g., key 115A is positioned at the 9:00 position of keyway 116A and key 115B is positioned at the 3:00 position of keyway 116B). The keys and keyways associated with support arm 108B have a similar orientation which prevents further rotation of the support arm 108B in the clockwise direction. When the support arms 108A, 108B are in the "open" position as shown in FIG. 4, the support area 180 is open opposite the support frame 105.

Figure 5A:
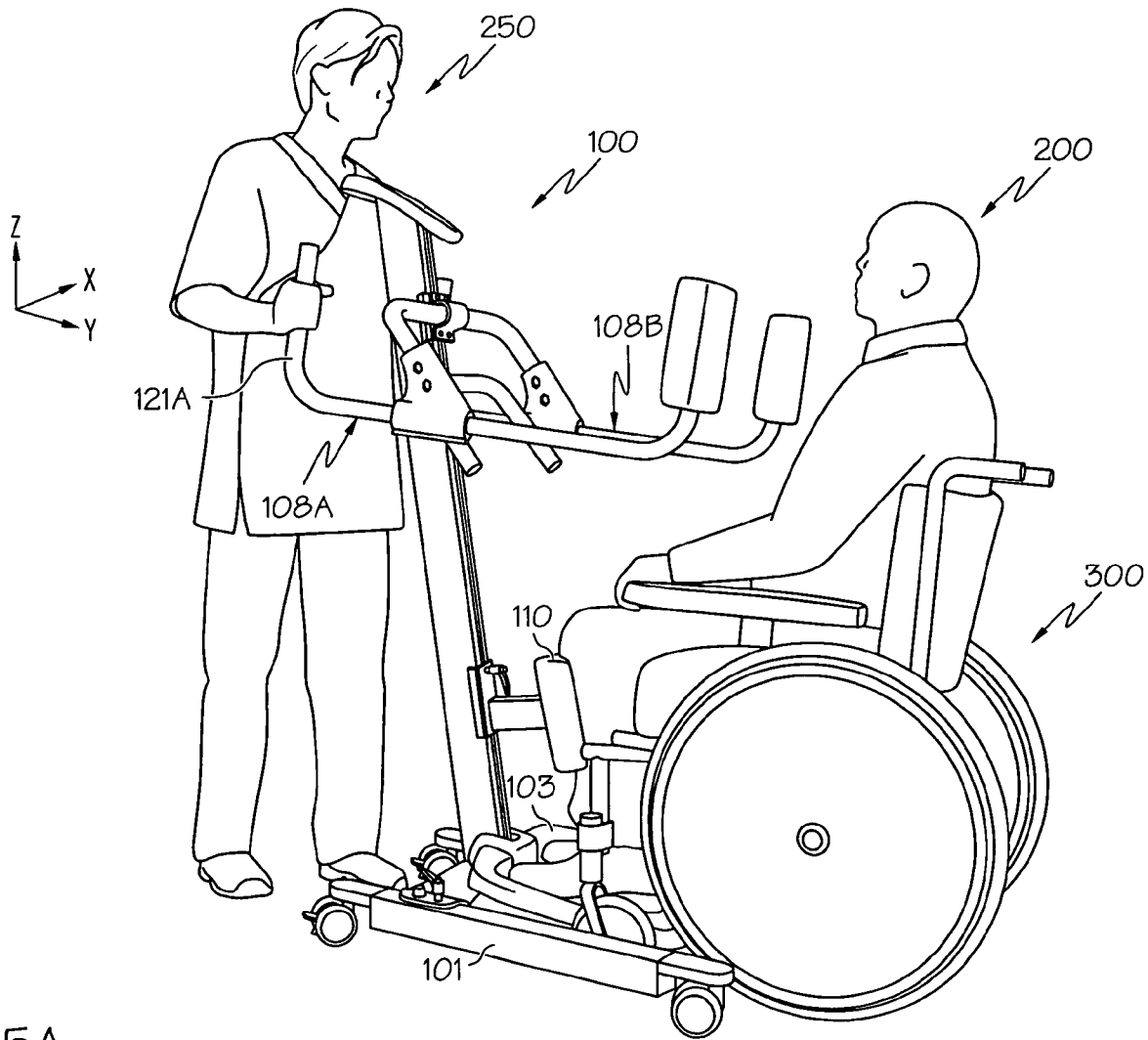
FIGS. 5A-5C depict the transport apparatus of FIG. 1 in use according to one embodiment shown and described herein.
Figure 5B:
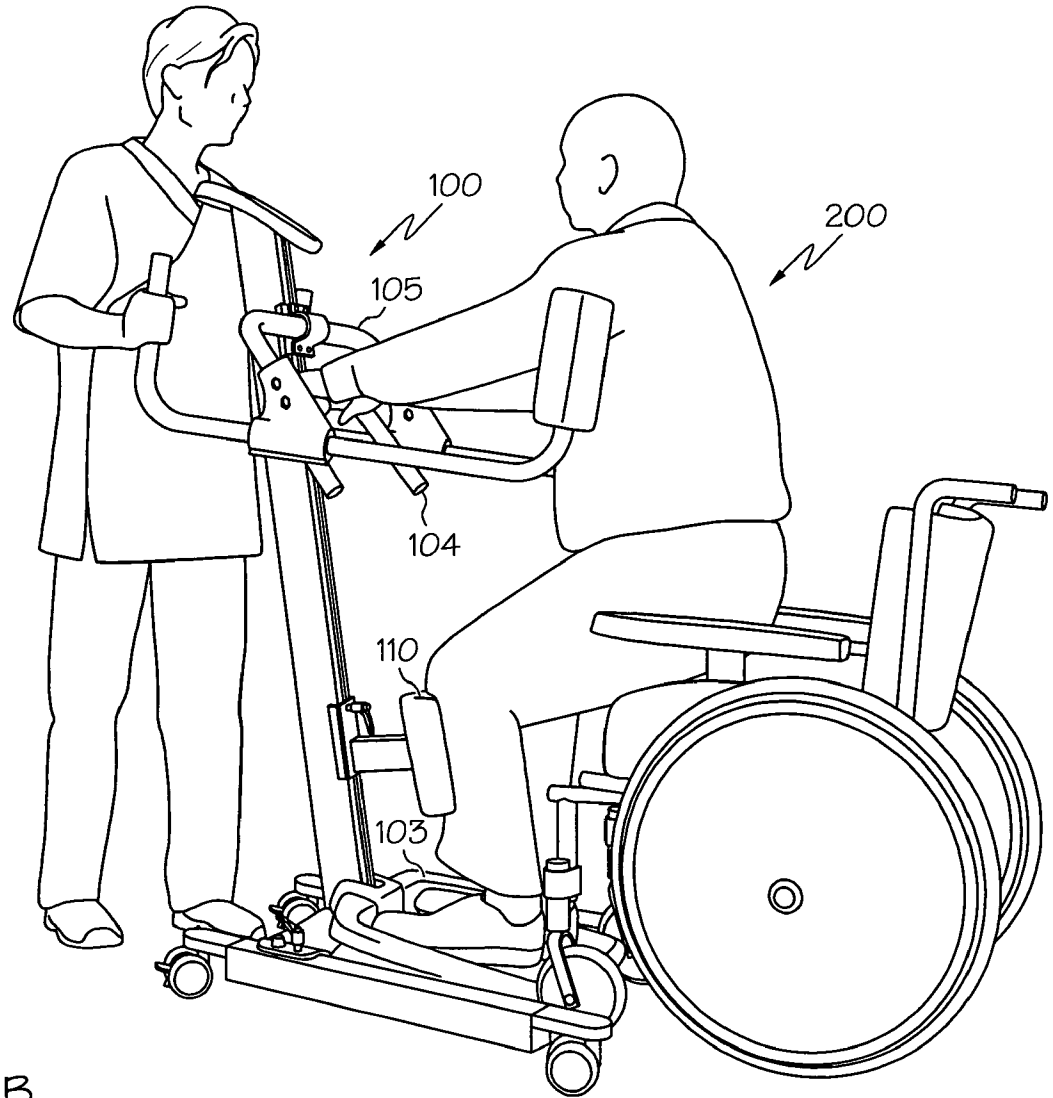
Figure 5C:
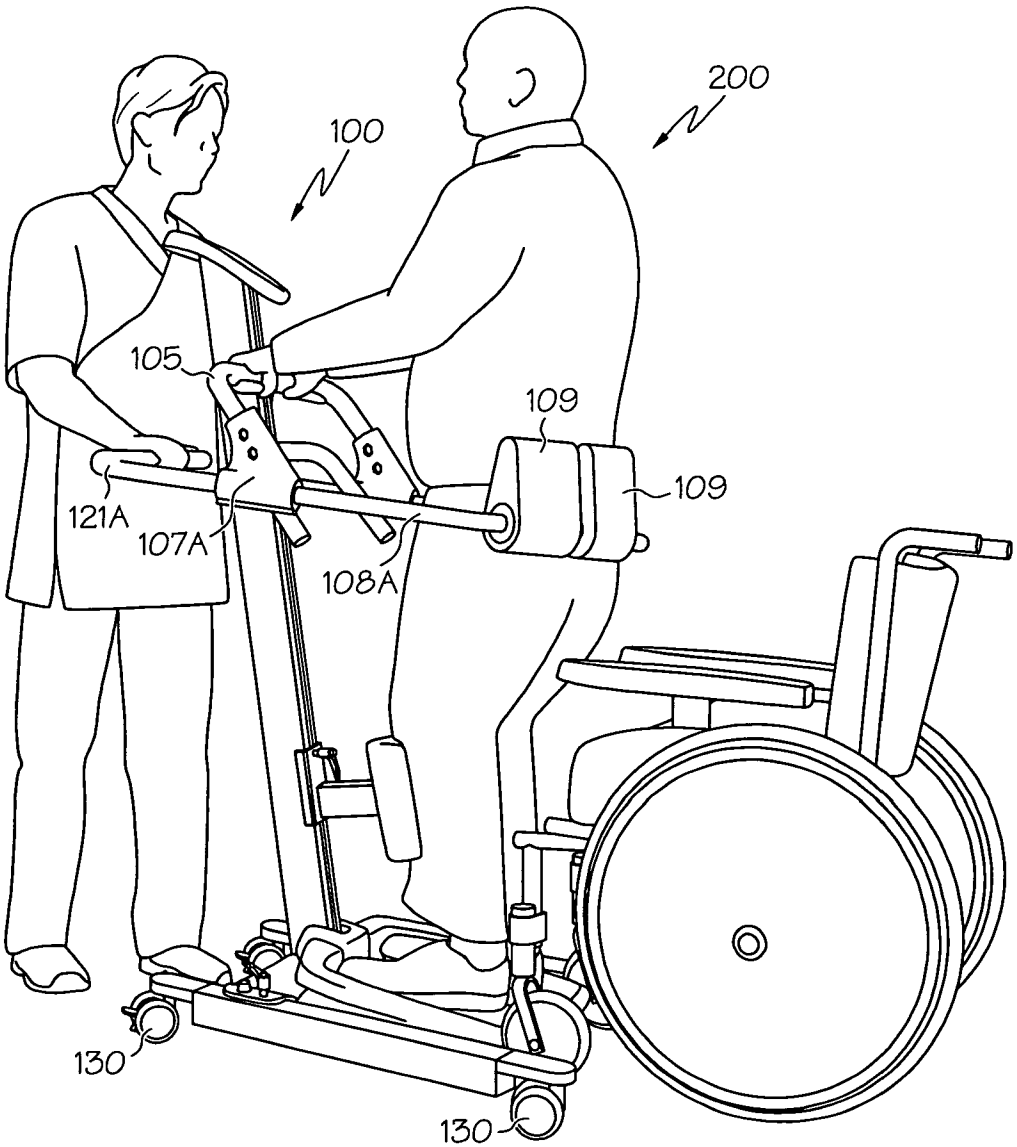

Referring now to FIGS. 5A-5C, one embodiment of a transport apparatus 100 is shown in use. In order to move an individual such as the individual 200 sitting in a wheel chair 300 with the assistance of the transport apparatus 100, an assistant 250 first positions the support arms 108A, 108B and guide handles 121A, 121B of the transport apparatus 100 in an "open" position which permits the individual to be positioned in the support area 180 between the support arms 108A, 108B such that the individual may be subsequently enclosed between the supports 109 and the support frame 105 when the support arms 108A, 108B are in the "closed" position. In the embodiments of the transport apparatus 100 shown and described herein, the support arms 108A, 108B may be positioned in the "open" position by rotating the support arms 108A, 108B with the guide handles 121A, 121B such that the supports 109 are substantially vertical (e.g., substantially parallel to the z-direction in FIG. 5A).

The transport apparatus 100 may then be positioned relative to the individual 200 to be transported. The transport apparatus 100 may be positioned such that the individual 200 may place his or her feet on the foot plate 103. When the lifting apparatus 100 comprises a lower leg support plate 110, as shown in FIG. 5A, the transport apparatus 100 may be positioned relative to the individual 200 such that, when the individual's feet are positioned on the foot plate 103, the individual's lower leg contacts the lower leg support plate 110. The individual 200 may then grip the handle frame 104 and, with his/her feet on the foot plate 103 and lower legs/knees against the support plate 110, the individual may pull himself/herself up to a standing position as shown in FIG. 5C.

Once the individual is in a standing position, the assistant 250 may then position the support arms 108A, 108B and guide handles 121A, 121B in the "closed" position by rotating the support arms 108A, 108B with respective guide handles 121A, 121B towards one another until the supports 109 are substantially horizontal (e.g., in the x-y plane or a parallel plane), as shown in FIG. 5C, such that the supports 109 are positioned behind the individual 200 thereby providing support to the back of the individual 200. In one embodiment, the supports 109 may be positioned below the curve of the individual's back and particularly against the buttocks of the person.

With the support arms 108A, 108B in the "closed" position, the individual 200 is positioned in the support area 180 between the support arms 108A, 108B and between the support frame 105 and supports 109. The support arms 108A, 108B provide lateral support to the individual 200 (e.g., support in the x-direction) while the support frame and supports provide longitudinal support (e.g., support in the y-direction). The individual 200 may also rest against the cushion 111 on the mast 102 as necessary. The longitudinal and lateral support facilitates using the transport apparatus 100 to transport or move the individual 200 while in the standing position. Specifically, the assistant 250 may push and/or pull the transport apparatus 100 on the castors 130 thereby moving the transport apparatus 100 and individual 200 to the desired location at which point the transport apparatus 100 may be used to assist the individual into a seating position utilizing the reverse of the procedure described above.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

The invention claimed is:

1. A transport apparatus for transporting an individual in a standing position, the transport apparatus comprising a wheeled base and a support mast extending substantially vertically from the wheeled base, wherein:

a foot plate is positioned at a lower end of the support mast; and a support frame assembly is positioned on the support mast above the foot plate, the support frame assembly comprising a support frame with a pair of downwardly directed mounting posts having a support arm pivotally attached to an end of each mounting post, the support arms each comprising a back support, wherein the support arms are parallel to one another and substantially horizontal and comprise and open position and a closed position such that, when the support arms are in the closed positioned, the supports are substantially horizontally oriented and define a support area between the support arms, the supports and the support frame and, when the support arms are in the open position, the supports are substantially vertically oriented and the support area is open opposite the support frame.

2. The transport apparatus of claim 1 wherein the support arms are each pivotally attached to the mounting posts with a locking mechanism, the locking mechanism comprising a blind bore for fixedly receiving one of the mounting posts and a horizontally oriented through bore for pivotally receiving one of the support arms.

3. The transport apparatus of claim 2 wherein:

the through bore of each locking mechanism comprises a pair of opposed keyways, each keyway extending partially around a circumference of the through bore; and each support arm is positioned in a sleeve comprising a pair of opposed keys such that, when the support arms are positioned in the through bores of the locking mechanism, the keys are positioned in the keyways such that the support arms may be rotated in the locking mechanism by at least about 90 degrees.

4. The transport apparatus of claim 3 wherein the sleeve comprises flanged end portions.

5. The transport apparatus of claim 1 wherein the wheeled base is substantially U-shaped.

6. The transport apparatus of claim 1 further comprising a handle frame positioned on the support mast.

7. The transport apparatus of claim 6 wherein the handle frame assembly is adjustably positioned on the support mast between the support frame assembly and the foot plate.

8. The transport apparatus of claim 1 further comprising a lower leg support plate positioned on the support mast.

9. The transport apparatus of claim 8 wherein the lower leg support plate is adjustably positioned on the support mast between the foot plate and the support frame assembly.

10. The transport apparatus of claim 1 further comprising a cushion positioned on an upper end of the support mast.

11. The transport apparatus of claim 1 wherein each support arm further comprises a guide handle.

12. The transport apparatus of claim 11 wherein the guide handles facilitate pivoting the support arms from the open position to the closed position and from the closed position to the open position.

13. A support frame assembly for attachment to a support mast of a transport apparatus, the support frame assembly comprising a support frame with a pair of downwardly directed mounting posts having a support arm pivotally attached to an end of each mounting post, the support arms each comprising a back support and an open position and a closed position, wherein, when the support arms are in the closed positioned, the back supports are substantially horizontally oriented defining a support area between the support arms, the back supports and the support frame and, when the support arms are in the open position, the back supports are substantially vertically oriented and the support area is open opposite the support frame.

14. The support frame assembly of claim 13 wherein the support arms are each pivotally attached to the mounting posts with a locking mechanism, the locking mechanism comprising a blind bore for fixedly receiving one of the mounting posts and a horizontally oriented through bore for pivotally receiving one of the support arms.

15. The support frame assembly of claim 14 wherein:

the through bore of each locking mechanism comprises a pair of opposed keyways, each keyway extending partially around a circumference of the through bore; and each support arm is positioned in a sleeve comprising a pair of opposed keys such that, when the support arms are positioned in the through bores of the locking mechanism, the keys are positioned in the keyways such that the support arms may be rotated in the locking mechanism by at least about 90 degrees.

16. The support frame assembly of claim 15 wherein the sleeve comprises flanged end portions.

17. A support frame assembly for attachment to a support mast of a transport apparatus, the support frame assembly comprising a support frame with a pair of downwardly directed mounting posts having a support arm pivotally attached to an end of each mounting post, the support arms each comprising a guide handle and a back support wherein, when the guide handles are in a closed positioned, the back supports are substantially horizontally oriented defining a support area between the support arms, the back supports and the support frame and, when the guide handles are in the open position, the back supports are substantially vertically oriented and the support area is open opposite the support frame.

18. The support frame assembly of claim 17 wherein the support arms are each pivotally attached to the mounting posts with a locking mechanism, the locking mechanism comprising a blind bore for fixedly receiving one of the mounting posts and a horizontally oriented through bore for pivotally receiving one of the support arms.

19. The support frame assembly of claim 18 wherein:

the through bore of each locking mechanism comprises a pair of opposed keyways, each keyway extending partially around a circumference of the through bore; and each support arm is positioned in a sleeve comprising a pair of opposed keys such that, when the support arms are positioned in the through bores of the locking mechanism, the keys are positioned in the keyways such that the support arms may be rotated in the locking mechanism by at least about 90 degrees.

20. The support frame assembly of claim 19 wherein the sleeve comprises flanged end portions.

* * * * *